US006551160B1

(12) United States Patent
Toth et al.

(10) Patent No.: US 6,551,160 B1
(45) Date of Patent: Apr. 22, 2003

(54) SURVIVAL SUIT

(76) Inventors: Louis Toth, 1901 SE. 56th Ct., Ocala, FL (US) 34471-5823; Lorraine Toth, 1901 SE. 56th Ct., Ocala, FL (US) 34471-5823

( * ) Notice: Subject to any disclaimer, the term of this patent is extended or adjusted under 35 U.S.C. 154(b) by 0 days.

(21) Appl. No.: 10/071,658

(22) Filed: Feb. 8, 2002

(51) Int. Cl.[7] ..... B63C 9/08
(52) U.S. Cl. ..... 441/104; 441/89
(58) Field of Search ..... 441/80, 102, 103, 441/104, 105, 89

(56) References Cited

U.S. PATENT DOCUMENTS

| | | | | | |
|---|---|---|---|---|---|
| 1,147,274 | A | * | 7/1915 | Simon | 441/103 |
| 1,314,299 | A | * | 8/1919 | Zaccard et al. | 441/103 |
| 2,181,159 | A | * | 11/1939 | Temple | 441/103 |
| 3,925,839 | A | * | 12/1975 | Smith | 441/104 |
| 4,242,769 | A | | 1/1981 | Rayfield et al. | |
| 4,673,366 | A | | 6/1987 | Hawkins | |
| 4,734,072 | A | | 3/1988 | Lastnik | |
| 5,013,271 | A | * | 5/1991 | Bartlett | 441/65 |
| 5,067,921 | A | | 11/1991 | Bramham | |
| 5,458,516 | A | | 10/1995 | Uglene et al. | |
| D429,384 | S | | 8/2000 | Crupi et al. | |

* cited by examiner

*Primary Examiner*—Stephen Avila

(57) ABSTRACT

A survival suit for providing a user with an inflatable suit that would keep its wearer afloat, keep them warm, and provide food and water in an emergency. The survival suit includes a main body portion and leg portions that extend from the main body portion. Arm portions extend from the main body portion and shoe portions extend from the leg portions. A hood portion extends from the main body portion. An inflatable bladder is coupled to the main body portion, the leg portions, the arm portions, the shoe portions, and the hood portion. An automatic inflation assembly is coupled to the main body portion and in environmental communication with the bladder to selectively inflate the bladder. The bladder extends along the side portions of the main body portion and the leg portions to facilitate free movement of a person in the anti-exposure suit.

15 Claims, 2 Drawing Sheets

SURVIVAL SUIT

BACKGROUND OF THE INVENTION

1. Field of the Invention

The present invention relates to anti-exposure suit and more particularly pertains to a new survival suit for providing a user with an inflatable suit that would keep its wearer afloat, keep them warm, and provide food and water in an emergency.

2. Description of the Prior Art

The use of anti-exposure suit is known in the prior art. U.S. Pat. No. 5,067,921 describes an inflatable immersion suit that has an inner layer that is inherently more elastic than the outer layer so as to ensure a close fitting around a user. Another type of anti-exposure suit is U.S. Pat. No. 4,734,072 having an anti-exposure suit that protects a user against environments of extremely cold temperatures.

While these devices fulfill their respective, particular objectives and requirements, the need remains for a device that includes features to keep the user nourished and hydrated as well as warm and afloat.

SUMMARY OF THE INVENTION

The present invention meets the needs presented above by providing the user with food and water as well as warmth in an emergency situation.

Still yet another object of the present invention is to provide a new survival suit that would prevent the user from drowning.

Even still another object of the present invention is to provide a new survival suit that would be very thin and fit like a pair of gloves, thus being comfortable for the user to wear and increasing the safety value of the present invention because the user would be more apt to be wearing the suit in when an unexpected emergency arose.

To this end, the present invention generally comprises a main body portion and leg portions that extend from the main body portion. Arm portions extend from the main body portion and shoe portions extend from the leg portions. A hood portion extends from the main body portion. An inflatable bladder is coupled to the main body portion, the leg portions, the arm portions, the shoe portions, and the hood portion. An automatic inflation assembly is coupled to the main body portion and in environmental communication with the bladder to selectively inflate the bladder. The bladder extends along the side portions of the main body portion and the leg portions to facilitate free movement of a person in the anti-exposure suit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
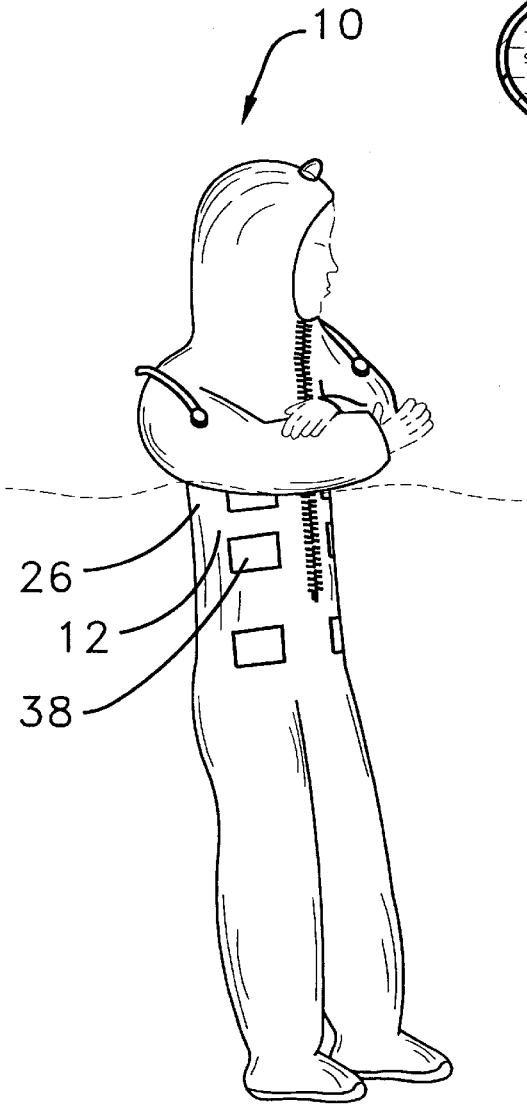
FIG. 1 is an in-use view of a new survival suit according to the present invention.
Figure 3:
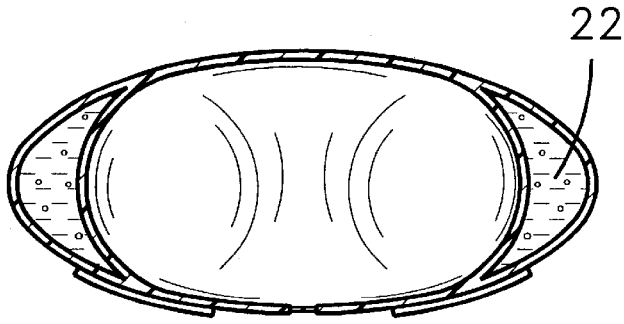
FIG. 3 is a top view of the present invention.
Figure 4:
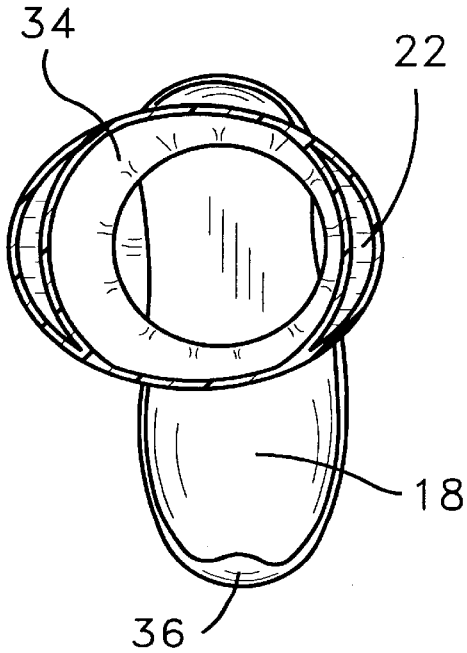
FIG. 4 is a top view of the present invention.
Figure 2:
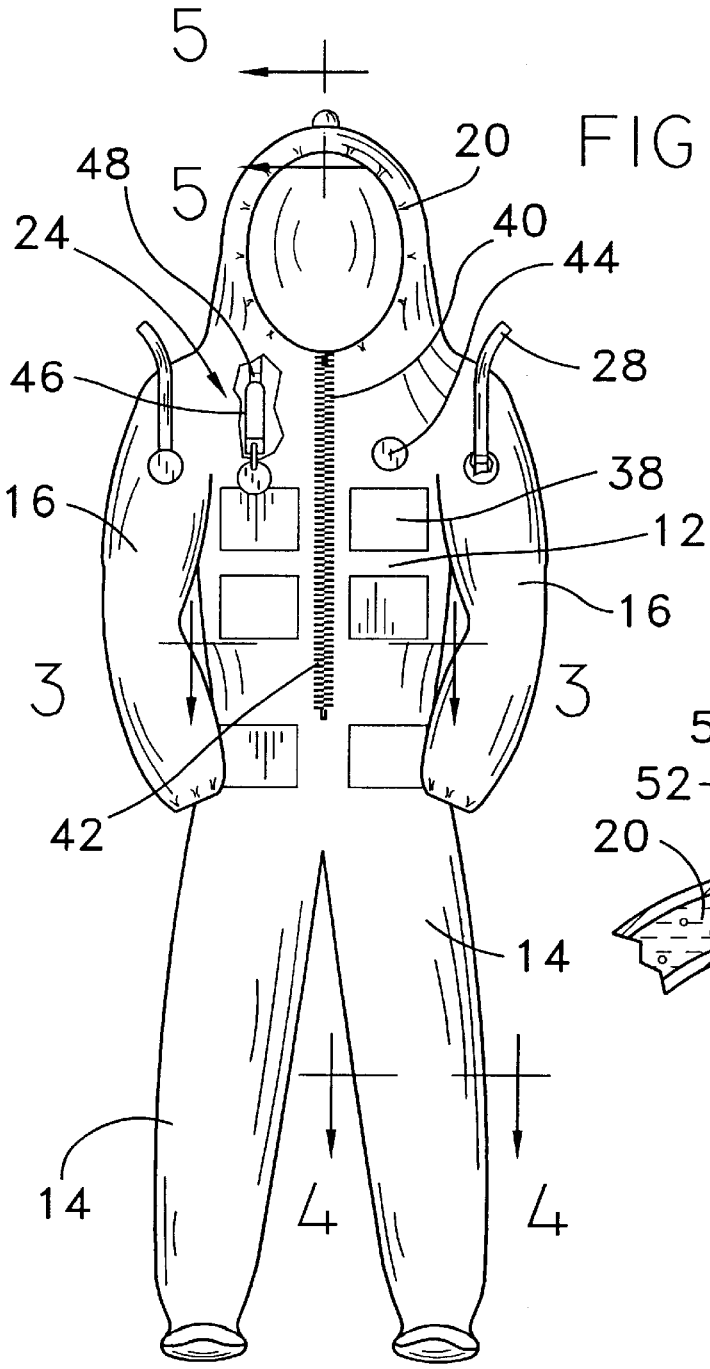
FIG. 2 is a front view of the present invention.
Figure 5:
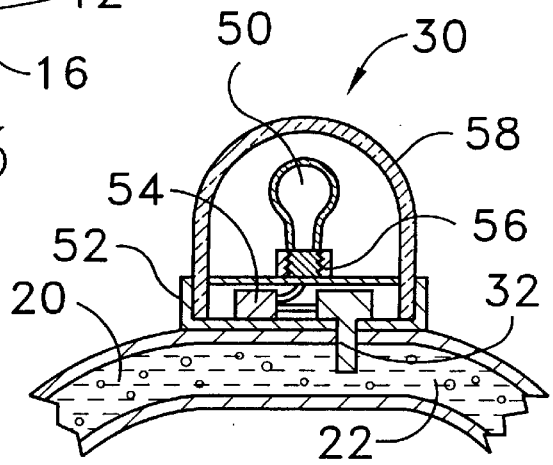
FIG. 5 is a cross-sectional view of the present invention.

With reference now to the drawings, and in particular to FIGS. 1 through 5 thereof, a new survival suit embodying the principles and concepts of the present invention and generally designated by the reference numeral 10 will be described.

As best illustrated in FIGS. 1 through 5, the survival suit 10 generally includes a main body portion 12 and leg portions 14 that extends from the main body portion 12. Arm portions 16 extend from the main body portion 12 and shoe portions 18 extend from the leg portions 14. A hood portion 20 extends from the main body portion 12. An inflatable bladder 22 is coupled to the main body portion 12, the leg portions 14, the arm portions 16, the shoe portions 18, and the hood portion 20. An automatic inflation assembly 24 is coupled to the main body portion 12 and in environmental communication with the bladder 22 to selectively inflate the bladder 22. The bladder 22 extends along the side portions 26 of the main body portion 12 and the leg portions 14 to facilitate free movement of a person in the anti-exposure suit.

A manual inflation tube 28 is coupled to the main body portion 12 and in environmental communication with the bladder 22 to permit manual inflation of the bladder 22. A light assembly 30 is coupled to the hood portion 20. The light assembly 30 is illuminated when the bladder 22 is inflated. The light assembly 30 includes a pressure switch 32 in environmental communication with the bladder 22 whereby the light is illuminated when the bladder 22 is inflated.

The bladder 22 extends along the top portions 34 of the shoe portions 18. Each of the shoe portions 18 has a rubber sole portion 36 positioned for supporting an upright person wearing the anti-exposure suit. Pockets 38 are coupled to the main body portion 12 to permit storage of food or water containers. A slit 40 extends along a front of the main body portion 12 for facilitating putting on of the anti-exposure suit. A closure means 42 is provided for selectively closing the slit 40 to secure the survival suit to a wearer. A release valve 44 is coupled to the main body portion 12 and in environmental communication with the bladder 22 for facilitating deflation of the bladder 22. The automatic inflation assembly 24 includes a carbon dioxide cartridge 46, the cartridge is coupled to a one-way valve 48 coupled to the bladder 22 and is openable to inflate the bladder 22.

The light assembly 30 includes a base housing 52, the base housing 52 is coupled to the hood portion 20. The light assembly 30 includes a battery 54 positioned in the base housing 52. A light socket 56 coupled to the base housing 52. A light 50 is coupled to the light socket 56 such that the light 50 extends from the base housing 52, and a dome member 58 coupled to the base housing 52 for protecting the light 50 from damage.

In use, a person would put on the suit covering their torso, arm portions, leg portions and foot portions. The bladders could be inflated manually or by blowing into the tubes that would protrude from the front of the suit near the shoulders.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An anti-exposure suit comprising:

a main body portion, leg portions extending from said main body portion, arm portions extending from said main body portion, shoe portions extending from said leg portions, and a hood portion extending from said main body portion:

an inflatable bladder coupled to said main body portion, said leg portions, said arm portions, said shoe portions, and said hood portion;

an automatic inflation assembly coupled to said main body portion and in environmental communication with said bladder to selectively inflate said bladder;

wherein said bladder extends along side portions of said main body portion and said leg portions to facilitate free movement of a person in said anti-exposure suit;

a light assembly coupled to said hood portion, said light assembly being illuminated when said bladder is inflated; and said light assembly including a pressure switch in environmental communication with said bladder whereby said light is illuminated when said bladder is inflated.

2. The anti-exposure suit of claim 1, further comprising:

a plurality of pockets coupled to said main body portion.

3. The anti-exposure suit of claim 1, further comprising:

a slit extending along a front of said main body portion for facilitating putting on of said anti-exposure suit; and a closure means for selectively closing said slit to secure said survival suit to a wearer.

4. The anti-exposure suit of claim 1, further comprising:

a release valve coupled to said main body portion and in environmental communication with said bladder for facilitating deflation of said bladder.

5. The anti-exposure suit of claim 1, wherein said automatic inflation assembly includes a carbon dioxide cartridge, said cartridge being coupled to a one-way valve coupled to said bladder, said one-way valve being openable to inflate said bladder.

6. The anti-exposure suit of claim 1, further comprising:

said light assembly including a base housing, said base housing being coupled to said hood portion;

said light assembly including a battery positioned in said base housing, a light socket coupled to said base housing, a light coupled to said light socket such that said light extends from said base housing, and a dome member coupled to said base housing for protecting said light from damage.

7. The anti-exposure suit of claim 1, further comprising:

a manual inflation tube coupled to said main body portion and in environmental communication with said bladder to permit manual inflation of said bladder.

8. An anti-exposure suit comprising:

a main body portion, leg portions extending from said main body portion, arm portions extending from said main body portion, shoe portions extending from said leg portions, and a hood portion extending from said main body portion;

an inflatable bladder coupled to said main body portion, said leg portions, said arm portions, said shoe portions, and said hood portion;

an automatic inflation assembly coupled to said main body portion and in environmental communication with said bladder to selectively inflate said bladder;

wherein said bladder extends along side portions of said main body portion and said leg portions to facilitate free movement of a person in said anti-exposure suit;

said bladder extending along top portions of said shoe portions, each of said shoe portions having a rubber sole portion positioned for supporting an upright person wearing said anti-exposure suit.

9. The anti-exposure suit of claim 8, further comprising:

a manual inflation tube coupled to said main body portion and in environmental communication with said bladder to permit manual inflation of said bladder.

10. The anti-exposure suit of claim 8, further comprising:

a light assembly coupled to said hood portion, said light assembly being Illuminated when said bladder is inflated.

11. The anti-exposure suit of claim 8, further comprising:

a plurality of pockets coupled to said main body portion.

12. The anti-exposure suit of claim 8, further comprising:

a slit extending along a front of said main body portion for facilitating putting on of said anti-exposure suit; and a closure means for selectively closing said slit to secure said survival suit to a wearer.

13. The anti-exposure suit of claim 8, further comprising:

a release valve coupled to said main body portion and in environmental communication with said bladder for facilitating deflation of said bladder.

14. The anti-exposure suit of claim 8 wherein said automatic inflation assembly includes a carbon dioxide cartridge, said cartridge being coupled to a one-way valve coupled to said bladder, said one-way valve being openable to inflate said bladder.

15. An anti-exposure suit comprising:

a main body portion, leg portions extending from said main body portion, arm portions extending from said main body portion, shoe portions extending from said leg portions, and a hood portion extending from said main body portion;

an inflatable bladder coupled to said main body portion, said leg portions, said arm portions, said shoe portions, and said hood portion;

an automatic inflation assembly coupled to said main body portion and in environmental communication with said bladder to selectively inflate said bladder;

wherein said bladder extends along side portion of said main body portion and said leg portions to facilitate free movement of a person in said anti-exposure suit;

a manual inflation tube coupled to said main body portion and in environmental communication with said bladder to permit manual inflation of said bladder;

a light assembly communication with said bladder whereby said light is illuminated when said bladder is inflated;

said bladder extending along top portion of said shoe portions, each of said shoe portions having a rubber sole portion positioned for supporting an upright person wearing said anti-exposure suit;

a plurality of pockets coupled to said main body portion;

a slit extending along a front of said main body portion for facilitating putting on of said anti-exposure suit;

a closure means for selectively closing said slit to secure said survival suit to a wearer;

a release valve coupled to said main body portion and in environmental communication with said bladder for facilitating deflation of said bladder;

wherein said automatic inflation assembly includes a carbon dioxide cartridge, said cartridge being coupled to a one-way valve coupled to said bladder, said one-way valve being openable to inflate said bladder;

said light assembly including a base housing, said base housing being coupled to said hood portion;

said light assembly including a battery positioned in said base housing, a light socket coupled to said base housing, a light coupled to said light socket such that said light extends from said base housing, and a dome member coupled to said base housing for protecting said light from damage.

* * * * *